US010465898B2

(12) United States Patent
Kosugi et al.

(10) Patent No.: US 10,465,898 B2
(45) Date of Patent: Nov. 5, 2019

(54) VEHICLE LIGHTING DEVICE AND VEHICLE LAMP

(71) Applicant: Toshiba Lighting & Technology Corporation, Yokosuka-shi, Kanagawa-ken (JP)

(72) Inventors: Daisuke Kosugi, Yokosuka (JP); Toshihiro Hatanaka, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 136 days.

(21) Appl. No.: 15/270,427

(22) Filed: Sep. 20, 2016

(65) Prior Publication Data

US 2017/0146213 A1 May 25, 2017

(30) Foreign Application Priority Data

Nov. 25, 2015 (JP) ..... 2015-229359

(51) Int. Cl.

| | |
|---|---|
| ***F21S 8/10*** | (2006.01) |
| ***F21V 29/76*** | (2015.01) |
| ***F21S 43/19*** | (2018.01) |
| ***F21S 43/14*** | (2018.01) |
| ***F21S 45/47*** | (2018.01) |
| ***F21S 45/50*** | (2018.01) |
| ***F21S 45/48*** | (2018.01) |
| *F21S 45/49* | (2018.01) |
| *F21V 15/01* | (2006.01) |
| *F21V 23/06* | (2006.01) |
| *F21V 31/00* | (2006.01) |

(52) U.S. Cl.

CPC ..... *F21V 29/767* (2015.01); *F21S 43/14* (2018.01); *F21S 43/195* (2018.01); *F21S 45/47* (2018.01); *F21S 45/48* (2018.01); *F21S 45/50* (2018.01); *F21S 45/49* (2018.01); *F21V 15/01* (2013.01); *F21V 23/06* (2013.01); *F21V 31/005* (2013.01)

(58) Field of Classification Search

None

See application file for complete search history.

(56) References Cited

U.S. PATENT DOCUMENTS

| | | | | |
|---|---|---|---|---|
| 7,621,667 | B2 | 11/2009 | Behr et al. | |
| 2008/0117647 | A1 | 5/2008 | Behr et al. | |
| 2010/0128479 | A1* | 5/2010 | Biebl | F21K 9/00 362/249.02 |

(Continued)

FOREIGN PATENT DOCUMENTS

| | | | |
|---|---|---|---|
| JP | 2008-524862 | A | 7/2008 |
| JP | 2012-043750 | A | 3/2012 |

(Continued)

*Primary Examiner* — Elmito Breval

(74) *Attorney, Agent, or Firm* — Banner & Witcoff, Ltd.

(57) ABSTRACT

According to one embodiment, a vehicle lighting device includes a loading portion; a substrate provided on one end side of the loading portion; a plurality of light emitting elements that are electrically connected to a wiring pattern provided on a surface of the substrate and provided side by side in a row in a first direction; and a plurality of power supply terminals that are electrically connected to the wiring pattern provided on the surface of the substrate and provided side by side in a row in a second direction perpendicular to the first direction.

19 Claims, 7 Drawing Sheets

(56) References Cited

U.S. PATENT DOCUMENTS

| | | | | |
|---|---|---|---|---|
| 2011/0175529 | A1* | 7/2011 | Hayashi | F21V 19/003 315/77 |
| 2011/0181186 | A1* | 7/2011 | Nakano | H05B 33/0806 315/77 |
| 2012/0026747 | A1* | 2/2012 | Hayashi | F21V 31/04 362/520 |
| 2012/0075880 | A1* | 3/2012 | Hayashi | F21S 41/141 362/547 |
| 2015/0016136 | A1* | 1/2015 | Nakano | F21S 48/212 362/520 |
| 2015/0211725 | A1* | 7/2015 | Ikuta | F21S 41/192 362/382 |

FOREIGN PATENT DOCUMENTS

| | | | |
|---|---|---|---|
| JP | 2012-074186 | A | 4/2012 |
| JP | 2013-077463 | A | 4/2013 |
| JP | 2013-235649 | A | 11/2013 |
| JP | 2014-026769 | A | 2/2014 |

* cited by examiner

VEHICLE LIGHTING DEVICE AND VEHICLE LAMP

CROSS-REFERENCE TO RELATED APPLICATIONS

This application is based upon and claims the benefit of priority from the prior Japanese Patent Application No. 2015-229359, filed on Nov. 25, 2015; the entire contents of which are incorporated herein by reference.

FIELD

Embodiments described herein relate generally to a vehicle lighting device and a vehicle lamp.

BACKGROUND

There is a vehicle lighting device including a socket and a light emitting module that is provided on one end side of the socket and has a light emitting diode (LED).

If radiation of heat generated in the light emitting diode is not sufficient, there is a concern that an increase in temperature of the light emitting diode cannot be suppressed. If the temperature of the light emitting diode becomes too high, there is a concern that a service life of the light emitting diode is shortened, or a voltage applied to the light emitting diode cannot be increased and thus an increase in a light amount cannot be achieved.

Therefore, a vehicle lighting device which can efficiently discharge heat generated in the light emitting diode to the outside is proposed.

Here, in a case of a vehicle lighting device provided in vehicles such as automobiles, light distribution characteristics for the vehicle in which light distribution are wide in a horizontal direction (rightward and leftward direction) and are narrow in a vertical direction (upward and downward direction) may be required.

Then, development of a vehicle lighting device, which has light distribution characteristics for a vehicle and can improve heat radiation, is desired.

DETAILED DESCRIPTION

Figure 1:
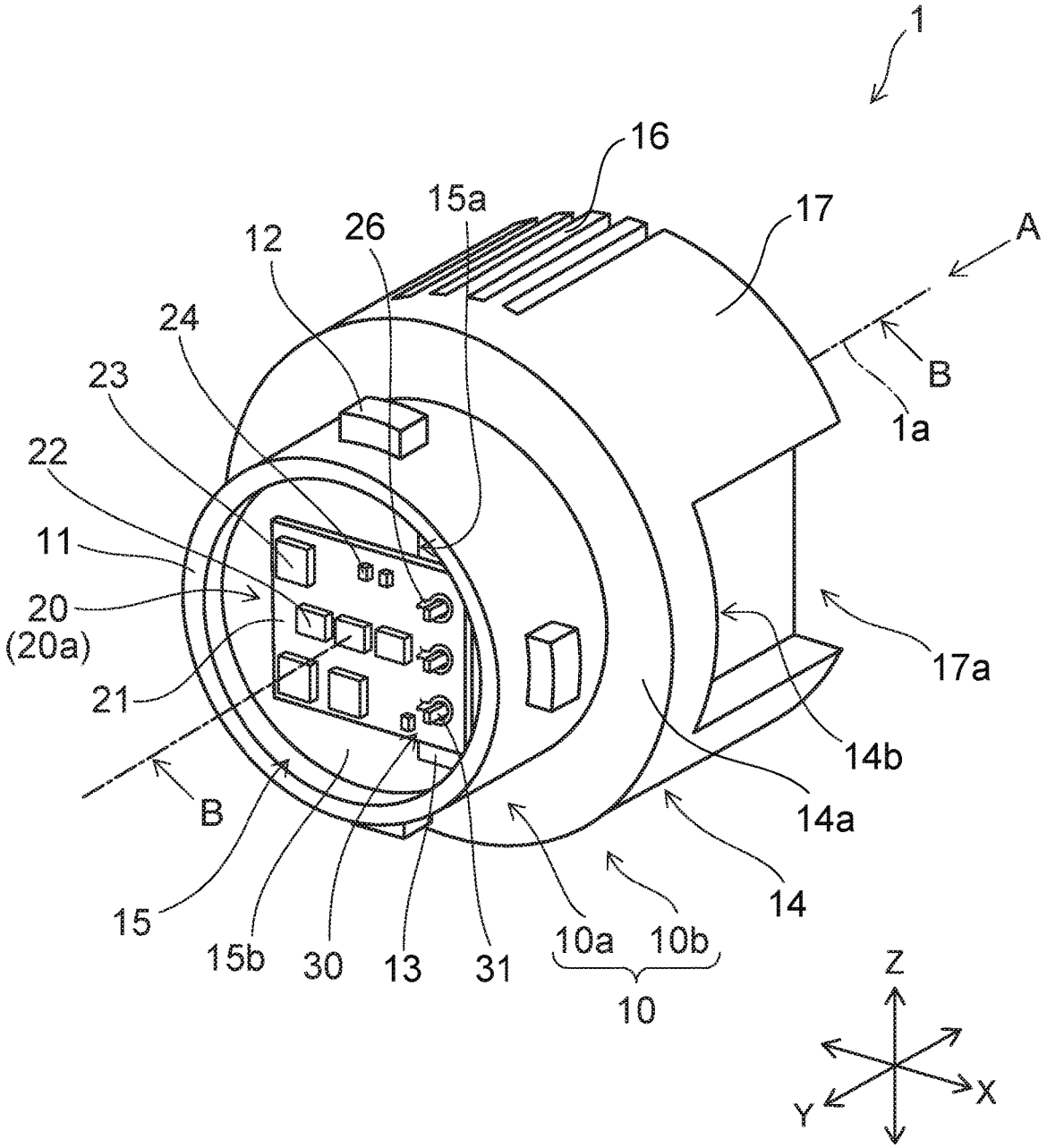
FIG. 1 is a schematic perspective view illustrating a vehicle lighting device according to an embodiment.

A vehicle lighting device according to an exemplary embodiment includes a loading portion; a substrate provided on one end side of the loading portion; a plurality of light emitting elements that are electrically connected to a wiring pattern provided on a surface of the substrate and provided side by side in a row in a first direction; and a plurality of power supply terminals that are electrically connected to the wiring pattern provided on the surface of the substrate and provided side by side in a row in a second direction perpendicular to the first direction.

According to the vehicle lighting device, light distribution characteristics for vehicle is provided and it is possible to improve the heat radiation.

In this case, the first direction is a direction that is a horizontal direction when the vehicle lighting device is attached to a vehicle lamp. The second direction is a direction that is a vertical direction when the vehicle lighting device is attached to a vehicle lamp.

Therefore, it is possible to obtain the light distribution characteristics for vehicle which are wide in the horizontal direction (rightward and leftward direction) and are narrow in the vertical direction (upward and downward direction). In addition, since a dimension (or dimension of a connector 105) of a convex portion 17 in the horizontal direction can be shortened, it is possible to make a region in which a plurality of heat radiating fins 16 are provided wide. As a result, since the number of heat radiating fins 16 can be increased, it is possible to further improve the heat radiation.

In addition, the vehicle lighting device may further include a plurality of heat radiating fins that are provided on a side opposite to a side of the loading portion on which the substrate is provided and are provided side by side in a row in the first direction.

Therefore, flow of a rising air flow 300 is prevented from being hindered by the plurality of heat radiating fins in a region in which the plurality of heat radiating fins 16 are provided.

In addition, the heat radiating fins have a plate shape and can extend in the second direction.

Therefore, flow of the rising air flow 300 is prevented from being hindered by the plurality of heat radiating fins in the region in which the plurality of heat radiating fins 16 are provided.

In addition, the substrate includes a first portion which has a hole penetrating in a thickness direction and in which the wiring pattern to which the plurality of power supply terminals are electrically connected is provided; and a second portion which is provided on an inside of the hole of the first portion and has thermal conductivity higher than that of the first portion, and in which the wiring pattern to which the plurality of light emitting elements are electrically connected is provided.

Therefore, it is possible to improve the heat radiation and to achieve reduction in manufacturing cost.

Hereinafter, exemplary embodiments will be described with reference to the drawings. Moreover, the same reference numerals are given to the same configuration elements in each drawing and detailed description will be appropriately omitted.

As a vehicle lighting device 1 of the exemplary embodiment, for example, can be provided in automobiles, railway vehicles, or the like. As the vehicle lighting device 1 provided in the automobile, for example, a front combination light (formed by appropriately combining, for example, a daytime running lamp (DRL; Daylight Running Lamp), a position lamp, a turn signal lamp, and the like), a rear combination light (formed by appropriately combining, for example, a stop lamp, a tail lamp, a turn signal lamp, a back lamp, a fog lamp, and the like), and the like can be exemplified. However, application of the vehicle lighting device 1 is not limited to the examples.

FIG. 1 is a schematic perspective view illustrating the vehicle lighting device 1 according to the embodiment.

Figure 2:
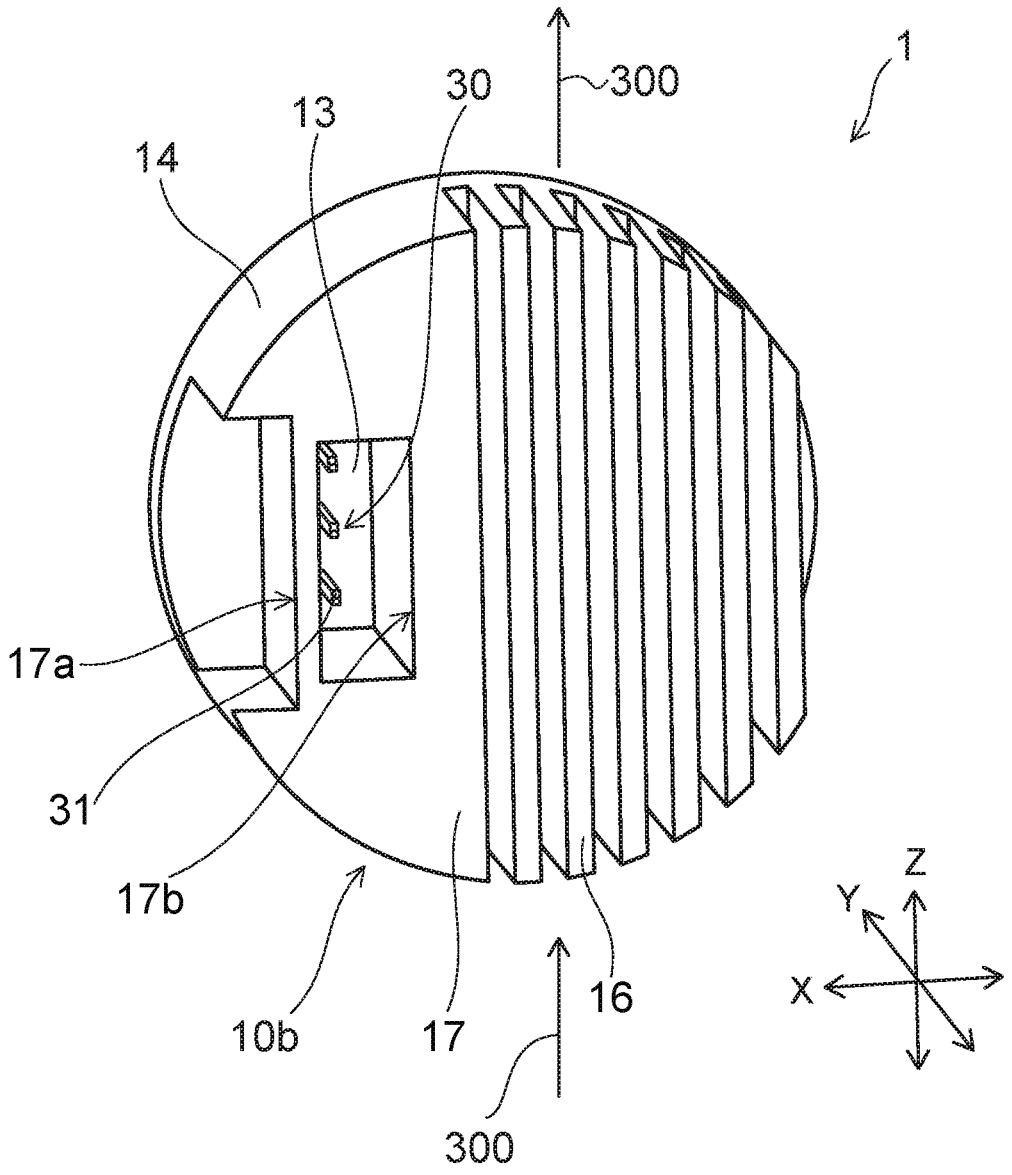
FIG. 2 is a schematic view of the vehicle lighting device viewed in a direction A in FIG. 1.

FIG. 2 is a schematic view of the vehicle lighting device 1 viewed in a direction A in FIG. 1.

Figure 3:
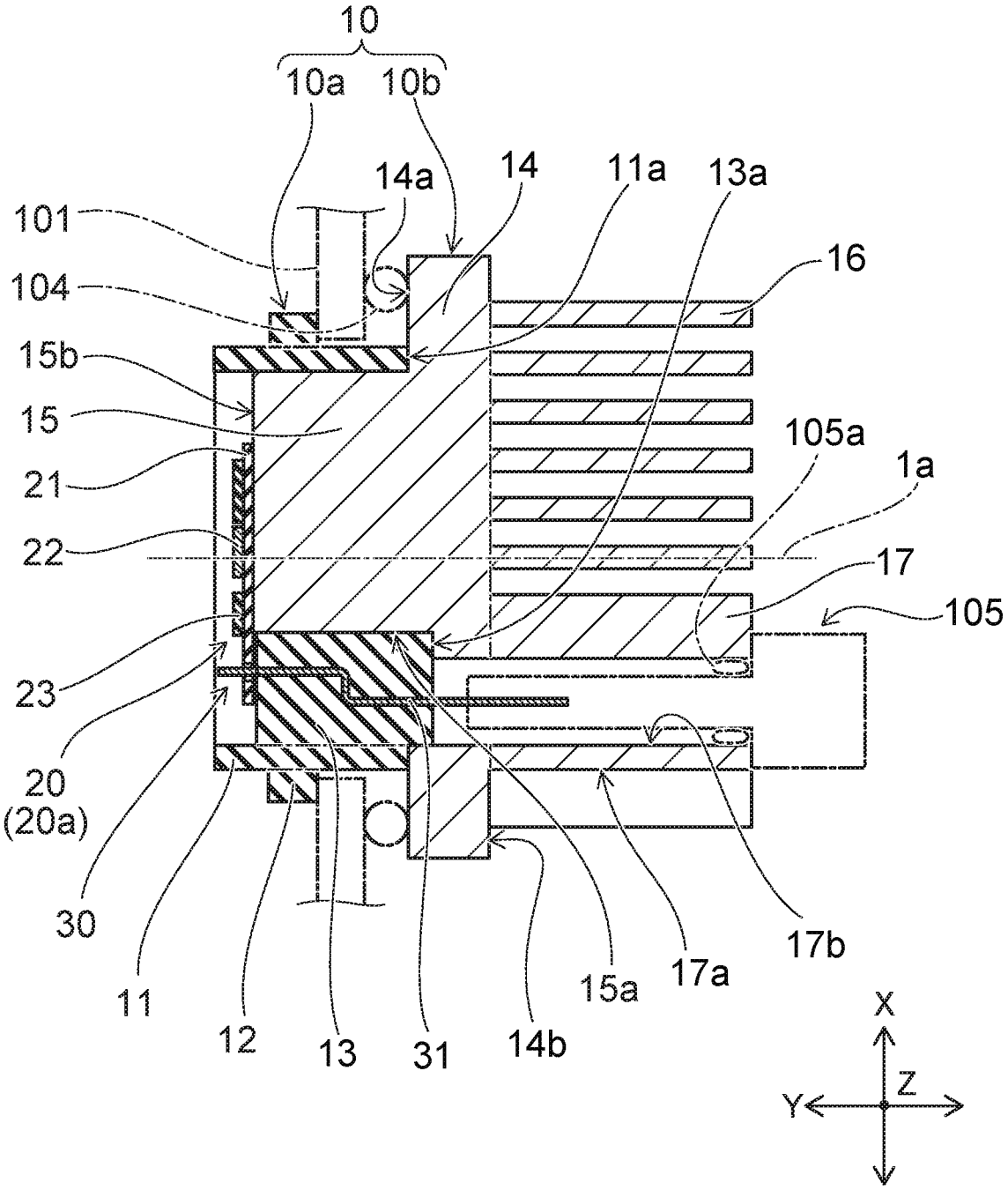
FIG. 3 is a schematic sectional view of the vehicle lighting device in a direction of line B-B in FIG. 1.

FIG. 3 is a schematic sectional view of the vehicle lighting device 1 in a direction of line B-B in FIG. 1.

FIGS. 4A to 4D are schematic sectional views illustrating a position of an end surface 11*a* of a mounting portion 11 on a flange 14 side and a position of an end surface 13*a* of an insulating portion 13 on the flange 14 side.

Moreover, an X direction, a Y direction, and a Z direction in each figure indicate three directions orthogonal to each other. For example, when attaching a vehicle lighting device 1 to a vehicle lamp 100, a direction that is a rightward and leftward direction (horizontal direction) can be the X direction, a direction that is a forward and rearward direction (horizontal direction) can be the Y direction, and a direction that is an upward and downward direction (vertical direction) can be the Z direction.

Moreover, the orthogonal herein refers to intersect at a range of 90°±5°.

As illustrated in FIGS. 1, 2, and 3, the vehicle lighting device 1 is provided with a socket 10, a light emitting module 20, and a power supplying portion 30.

The socket 10 has a storage portion 10*a* and a heat radiating portion 10*b*.

The storage portion 10*a* has the mounting portion 11, a bayonet 12, and the insulating portion 13.

The mounting portion 11 has a tubular shape. The mounting portion 11 can have, for example, a cylindrical shape. The mounting portion 11 is provided on a side of the flange 14 opposite to a side in which heat radiating fins 16 are provided. The mounting portion 11 surrounds a loading portion 15. An external dimension of the mounting portion 11 in a direction (X direction or the Z direction) orthogonal to a center axis 1*a* of the vehicle lighting device 1 is smaller than an external dimension of the flange 14.

The bayonet 12 is provided on an outside surface of the mounting portion 11 and protrudes to the outside of the vehicle lighting device 1. The bayonet 12 faces the flange 14. A plurality of bayonets 12 are provided.

Figure 7:
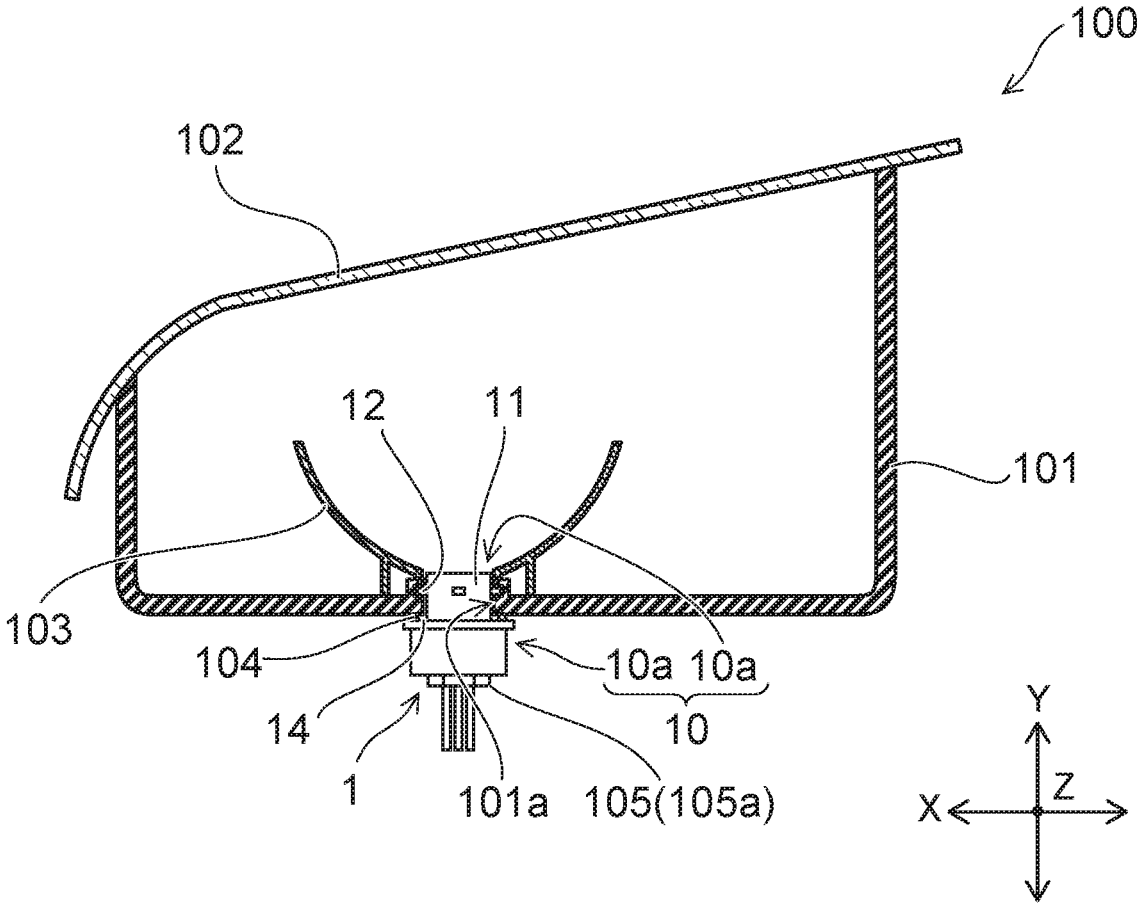
FIG. 7 is a schematic partial sectional view illustrating a vehicle lamp.

When mounting the vehicle lighting device 1 on a housing 101, a portion of the mounting portion 11 in which the bayonets 12 are provided is inserted into an attachment hole 101*a* provided in the housing 101 (see FIG. 7). Then, when rotating the vehicle lighting device 1, the vehicle lighting device 1 is held in the housing 101. That is, the bayonets 12 is provided to be used in twist-lock.

The insulating portion 13 is provided on an inside of the mounting portion 11.

Figure 4A:
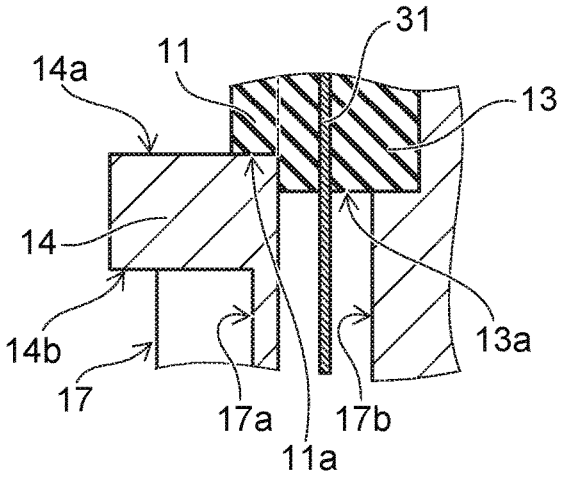
FIGS. 4A to 4D are schematic sectional views illustrating a position of an end surface of a mounting portion on a flange side and a position of an end surface of an insulating portion on the flange side.

Here, as illustrated in FIGS. 3 and 4A, the end surface 11*a* of the mounting portion 11 on the flange 14 side can be positioned on a surface 14*a* of the flange 14 on a side opposite to a side in which the heat radiating fins 16 are provided.

In addition, the end surface 13*a* of the insulating portion 13 on the flange 14 side can be positioned on an inside of the flange 14.

Figure 4B:
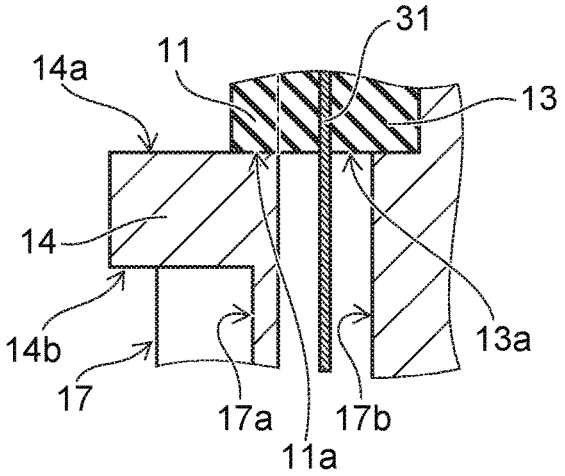

As illustrated in FIG. 4B, the end surface 11*a* of the mounting portion 11 on the flange 14 side can be positioned on the surface 14*a* of the flange 14.

In addition, the end surface 13*a* of the insulating portion 13 on the flange 14 side can be positioned on the surface 14*a* of the flange 14.

Figure 4D:
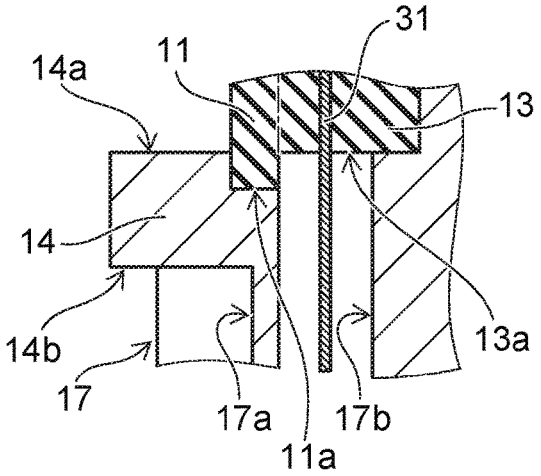
Figure 4C:
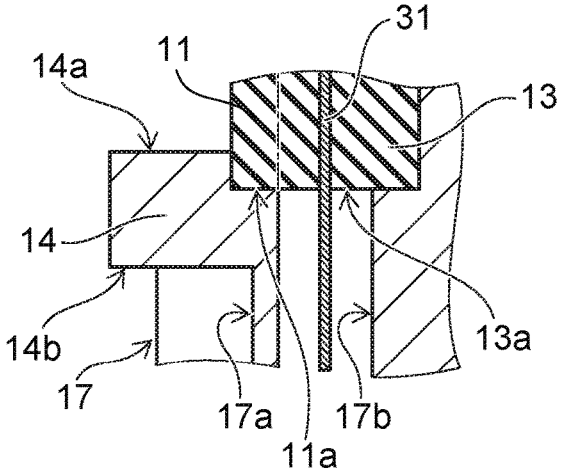

As illustrated in FIG. 4C, the end surface 11*a* of the mounting portion 11 on the flange 14 side can be positioned on the inside of the flange 14.

In addition, the end surface 13*a* of the insulating portion 13 on the flange 14 side can be positioned on the inside of the flange 14.

As illustrated in FIG. 4D, the end surface 11*a* of the mounting portion 11 on the flange 14 side can be positioned on the inside of the flange 14.

In addition, the end surface 13*a* of the insulating portion 13 on the flange 14 side can be positioned on the surface 14*a* of the flange 14.

In addition, a member (not illustrated) may be provided between the end surface 11*a* of the mounting portion 11 on the flange 14 side and the surface 14*a* of the flange 14. A member (not illustrated) may be provided between the end surface 13*a* of the insulating portion 13 on the flange 14 side and the surface 14*a* of the flange 14.

In addition, a protrusion portion protruding toward the mounting portion 11 and the insulating portion 13 can be provided in the surface 14*a* of the flange 14.

That is, the position of the end surface 11*a* of the mounting portion 11 on the flange 14 side and the position of the end surface 13*a* of the insulating portion 13 on the flange 14 side may be on the light emitting module 20 side more than the position of a surface 14*b* of the flange 14 on which the heat radiating fins 16 are provided.

The storage portion 10*a* can be formed by integrally molding the mounting portion 11, the bayonets 12, and the insulating portion 13 or can be formed by joining these members. However, if the mounting portion 11, the bayonet 12, and the insulating portion 13 are integrally molded, it is possible to improve resistance against an external force and achieve reduction in manufacturing cost.

The storage portion 10*a* has a function of storing the light emitting module 20 and a function of insulating the power supply terminal 31.

Therefore, it is preferable that the mounting portion 11, the bayonet 12, and the insulating portion 13 are formed of an insulating material. The insulating material can be, for example, an organic material such as resin, an inorganic material such as ceramics (for example, aluminum oxide, aluminum nitride, or the like), or the like.

In this case, it is also possible to form mounting portion 11, the bayonet 12, and the insulating portion 13 from the insulating material having high thermal conductivity considering that heat generated in the light emitting module 20 is transmitted to the outside. The insulating material having high thermal conductivity can be, for example, ceramics (for example, aluminum oxide, aluminum nitride, or the like) and resin having high thermal conductivity. Resin having high thermal conductivity is obtained, for example, by mixing fibers or particles made of aluminum oxide having high thermal conductivity to resin such as ployethylene terephthalate (PET), nylon, or the like.

Moreover, the mounting portion 11, the bayonet 12, and the insulating portion 13 can be also formed of a conductive material such as metal. However, it is necessary to provide a layer formed of the insulating material between the power supply terminal 31 and the insulating portion 13 or to form only the insulating portion 13 from the insulating material.

The heat radiating portion 10*b* has the flange 14, the loading portion 15, the heat radiating fins 16, and a convex portion 17.

The flange 14 has a plate shape. The flange 14 can have, for example, a disk shape. A distance between the outside surface of the flange 14 and the center axis 1*a* of the vehicle lighting device 1 is longer than a distance between the outside surface of the bayonet 12 and the center axis 1*a* of the vehicle lighting device 1. That is, the outside surface of the flange 14 is positioned on the outside of the vehicle lighting device 1 more than the outside surface of the bayonet 12.

The loading portion 15 can have a tubular shape. The loading portion 15 is provided on the surface 14*a* of the flange 14 on a side opposite to the side in which the heat radiating fins 16 are provided. A concave portion 15*a* is provided on the side surface of the loading portion 15. The insulating portion 13 is provided on the inside of the concave portion 15*a*. The light emitting module 20 (substrate 21) is loaded on a surface 15*b* of the loading portion 15 on a side opposite to the flange 14 side.

The heat radiating fins 16 are provided on the surface 14*b* of the flange 14 on a side opposite to the side in which the loading portion 15 is provided. A plurality of heat radiating fins 16 can be provided. The plurality of heat radiating fins 16 can be provided to parallel to each other. The heat radiating fins 16 can have a plate shape.

The convex portion 17 has a function of protecting an end portion of the power supply terminal 31 and a function of holding the connector 105. The convex portion 17 is provided on the surface 14*b* of the flange 14 in which the heat radiating fins 16 is provided. The convex portion 17 can have a block shape. A concave portion 17*a* is provided on an outside surface of the convex portion 17. The concave portion 17*a* is opened on the outside surface of the convex portion 17.

A hole 17*b* is provided in the convex portion 17. The hole 17*b* penetrates between an end surface of the convex portion 17 on a side opposite to the flange 14 side and the surface 14*a* of the flange 14 on a side opposite to the side in which the heat radiating fins 16 are provided. The end portion of the power supply terminal 31 protrudes on the flange 14 side of the hole 17*b*. A part of the insulating portion 13 is exposed on the flange 14 side of the hole 17*b*. That is, an opening of the hole 17*b* on the flange 14 side is closed by the insulating portion 13. The hole 17*b* is not connected to the concave portion 17*a*.

The connector 105 having a sealing member 105*a* is inserted into the hole 17*b*. Therefore, a cross section shape of the hole 17*b* is fitted to a cross section of the connector 105 having the sealing member 105*a*.

In addition, a cross section dimension of the hole 17*b* in a direction orthogonal to the center axis 1*a* of the vehicle lighting device 1 is slightly smaller than an external shape dimension of the sealing member 105*a* provided in a body of the connector 105. Therefore, when the connector 105 having the sealing member 105*a* is inserted into the hole 17*b*, the hole 17*b* is sealed to be water tightness.

The heat radiating portion 10*b* can be formed by integrally molding the flange 14, the loading portion 15, the heat radiating fins 16, and the convex portion 17 or can be formed by joining these members by individually forming these members. However, if the flange 14, the loading portion 15, the heat radiating fins 16, and the convex portion 17 are integrally molded, it is possible to improve the heat radiation property, to improve resistance against an external force, to achieve reduction in manufacturing cost, and the like.

The heat radiating portion 10*b* has a function of loading the light emitting module 20 and a function of discharging heat generated in the light emitting module 20 to the outside.

Therefore, it is preferable that the flange 14, the loading portion 15, the heat radiating fins 16, and the convex portion 17 are formed of a material having high thermal conductivity. The material having high thermal conductivity can be metal such as aluminum and aluminum alloy, ceramics such as aluminum oxide and aluminum nitride, resin having high thermal conductivity, or the like.

In this case, the material of the storage portion 10*a* and the material of the heat radiating portion 10*b* can be different from each other. For example, the storage portion 10*a* is formed of the insulating material such as resin and the heat radiating portion 10*b* can be formed of the material having high thermal conductivity such as metal (for example, aluminum alloy and the like).

Here, the mounting portion 11 is provided on a side of the flange 14 opposite to the side in which the heat radiating fins 16 are provided. In addition, the mounting portion 11 surrounds the loading portion 15. However, the mounting portion 11 does not surround the flange 14, the heat radiating fins 16, and the convex portion 17.

Therefore, it is possible to efficiently discharge heat generated in the light emitting module 20 to the outside via the flange 14, the heat radiating fins 16, and the convex portion 17 which are formed of a material having high thermal conductivity. That is, it is possible to improve the heat radiation property of the vehicle lighting device 1.

In addition, the heat radiating portion 10*b* is joined to the storage portion 10*a*. In this case, the insulating portion 13 of the storage portion 10*a* is inserted into the inside of the concave portion 15*a* of the heat radiating portion 10*b*. The loading portion 15 of the heat radiating portion 10*b* is inserted into the inside of the mounting portion 11 of the storage portion 10*a*.

The storage portion 10*a* and the heat radiating portion 10*b* may be fitted into each other, or may be joined using adhesive and the like. The storage portion 10*a* and the heat radiating portion 10*b* may be joined by insert molding, or the storage portion 10*a* and the heat radiating portion 10*b* may be joined by heat welding.

Here, if the storage portion 10*a* and the heat radiating portion 10*b* are bonded, interface is formed between the storage portion 10*a* and the heat radiating portion 10*b*. In the interface is formed between the storage portion 10*a* and the heat radiating portion 10*b*, there is a concern that moisture enter from the interface. In this case, if the storage portion 10*a* and the heat radiating portion 10*b* are bonded and the like, it is possible to suppress entrance of moisture from the interface. However, it is difficult to completely sealing the interface.

In addition, in a case of the vehicle lighting device 1 provided in the automobile, a temperature of environment of use is −40° C. to 85° C. Therefore, even if initially it is water tightness, there is a concern that water tightness is lowered together with elapse of time by thermal stress generated by a difference in thermal expansion.

Thus, in the embodiment, the position of the end surface 11*a* of the mounting portion 11 on the flange 14 side and the position of the end surface 13*a* of the insulating portion 13 on the flange 14 side are on the light emitting module 20 side more than the position of the surface 14*b* of the flange 14.

In addition, an external dimension of the mounting portion 11 in a direction orthogonal to the center axis 1*a* of the vehicle lighting device 1 is smaller than an external dimension of the flange 14.

Therefore, as illustrated in FIG. 3, the interface between the mounting portion 11 and the flange 14 can be sealed by the sealing member 104.

Moreover, a part of the insulating portion 13 is exposed on the flange 14 side of the hole 17*b*. That is, the interface between the insulating portion 13 and the flange 14 is exposed on the inside of the hole 17*b*. However, the connector 105 having the sealing member 105*a* is inserted into the hole 17*b*.

Therefore, when the connector 105 having the sealing member 105*a* is inserted into the hole 17*b*, the hole 17*b* is closed to be water tightness. As a result, it is possible to suppress that the moisture enters from the interface between the insulating portion 13 and the flange 14.

Moreover, the moisture is mainly on the outside of the housing 101 of a vehicle lamp 100. Therefore, moisture entering on the inside of the sealing member 104 from the inside of the housing 101 is little.

As described above, according to the vehicle lighting device 1 of the embodiment, it is possible to suppress that the moisture enters from the interface even if the storage portion 10*a* and the heat radiating portion 10*b* are bonded.

As illustrated in FIGS. 1 and 3, the light emitting module 20 is provided on the surface 15*b* of the loading portion 15 on the side opposite to the flange 14 side.

The light emitting module 20 has a substrate 21, a light emitting element 22, a control element 23, and a control element 24.

The substrate 21 is provided on the surface 15*b* of the loading portion 15. The substrate 21 has a plate shape. A wiring pattern 26 is provided on the surface of the substrate 21.

A material or a structure of the substrate 21 is not particularly limited. For example, the substrate 21 can be formed of an inorganic material such as ceramics (for example, aluminum oxide, aluminum nitride, and the like), an organic material such as paper phenol and glass epoxy, and the like. In addition, the substrate 21 may be obtained by coating a surface of a metal plate with an insulating material. Moreover, in a case where the surface of the metal plate is coated with the insulating material, the insulating material may be formed of an organic material or may be formed of an inorganic material.

In this case, if a heating value of the light emitting element 22 is large, it is preferable that the substrate 21 is formed by using a material having high thermal conductivity in terms of heat radiation. As the material having high thermal conductivity, ceramics such as aluminum oxide or aluminum nitride, a material that is obtained by coating a surface of a metal plate with an insulating material, and the like can be exemplified.

In addition, the substrate 21 may be a single layer or may be a multi-layer.

The light emitting element 22 is provided on the substrate 21. The light emitting element 22 is electrically connected to the wiring pattern 26 provided on the surface of the substrate 21. The light emitting element 22 can be, for example, a light emitting diode, an organic light emitting diode, a laser diode, and the like.

A form of the light emitting element 22 is not particularly limited.

The light emitting element 22 can be a light emitting element of a surface mounting type such as Plastic Leaded Chip Carrier (PLCC) type. Moreover, the light emitting element 22 illustrated in FIGS. 1 and 3 is the light emitting element of the surface mounting type.

The light emitting element 22 can be, for example, a light emitting element having a lead wire of a shell type and the like.

In addition, the light emitting element 22 can be mounted by Chip On Board (COB). In a case of the light emitting element 22 that is mounted by the COB, it is possible to provide the light emitting element 22 of a chip shape, wiring electrically connecting the light emitting element 22 and the wiring pattern 26, a frame-like member surrounding the light emitting element 22 and the wiring, a sealing portion provided on an inside of the frame-like member, and the like on the substrate 21.

In this case, the sealing portion can include a phosphor. The phosphor can be, for example, a YAG-based phosphor (yttrium-aluminum-garnet fluorescent material). For example, if the light emitting element 22 is a blue emitting diode and the phosphor is the YAG-based phosphor, the YAG-based phosphor is excited by blue light emitted from the light emitting element 22 and yellow fluorescence is emitted from the YAG-based phosphor. Then, white light is emitted from the vehicle lighting device 1 by mixing blue light and yellow light. Moreover, types of the phosphors and types of the light emitting elements 22 are not limited to the examples described above. The types of the phosphors and the types of the light emitting elements 22 can be appropriately changed such that a desired emitting color is obtained in accordance with the application of the vehicle lighting device 1 and the like.

A light emitting surface of the light emitting element 22 faces a front side of the vehicle lighting device 1 and mainly emits light on the front side of the vehicle lighting device 1.

The number, sizes, and arrangements of the light emitting elements 22 are not limited to the examples described above, and can be appropriately changed in accordance with the size and the application of the vehicle lighting device 1, and the like.

Here, as illustrated in FIG. 1, a plurality of light emitting elements 22 are provided side by side in a row in the X direction. As described above, the X direction is the direction that is the horizontal direction when attaching the vehicle lighting device 1 to the vehicle lamp 100. The Z direction is the direction that is the vertical direction when attaching the vehicle lighting device 1 to the vehicle lamp 100. In addition, a dimension of the row of the light emitting elements 22 in the X direction is longer than a dimension of the row of the light emitting elements 22 in the Z direction.

Therefore, light distribution characteristics of the vehicle lighting device 1 are wide in the horizontal direction and are narrow in the vertical direction. That is, the vehicle lighting device 1 can have the light distribution characteristics for vehicle which are wide in the horizontal direction and are narrow in the vertical direction.

The control element 23 is provided on the substrate 21. The control element 23 is electrically connected to the wiring pattern 26 provided on the surface of the substrate 21. The control element 23 can control, for example, a current flowing through the light emitting element 22.

Since there are variations in forward voltage characteristics of the light emitting element 22, if an applied voltage between an anode terminal and a ground terminal is constant, variations occur in brightness (light flux, luminance, luminous intensity, and illuminance) of the light emitting element 22. Therefore, a value of the current flowing through the light emitting element 22 is made to fall within a predetermined range by the control element 23 so that the brightness of the light emitting element 22 falls within a predetermined range.

The control element 23 can be, for example, a resistor. The control element 23 can be, for example, a resistor of a surface mounting type, a resistor (metal oxide film resistor) having a lead wire, a film-like resistor formed using a screen printing method, and the like.

Moreover, the control element 23 illustrated in FIGS. 1 and 3 is the resistor of the surface mounting type.

In this case, the value of the current flowing through the light emitting element 22 can be within a predetermined range by changing a resistance value of the control element 23. For example, in a case where the control element 23 is the film-like resistor, a part of the control element 23 is removed for a plurality of control elements 23 and a removed portion (not illustrated) is formed in each of the control elements 23. Then, the resistance value is changed for the plurality of control elements 23 by a size of the removed portion and the like. In this case, if a part of the control elements 23 is removed, the resistance value is increased. Removing of a part of the control elements 23 can be performed, for example, by applying laser light to the control element 23.

The number, sizes, and arrangements of the control elements 23 are not limited to the examples described above, and can be appropriately changed in accordance with the number and a specification of the light emitting element 22, and the like.

The control element 24 is provided on the substrate 21. The control element 24 is electrically connected to the wiring pattern 26 provided on the surface of the substrate 21. The control element 24 is provided so as not to apply a reverse voltage to the light emitting element 22 and not to apply pulse noise from the opposite direction to the light emitting element 22.

The control element 24 can be, for example, a diode. The control element 24 can be, for example, a diode of a surface mounting type, a diode having a lead wire, and the like. Moreover, the control element 24 illustrated in FIG. 1 is the diode of the surface mounting type.

In addition, it is also possible to provide a pull-down resistor to detect disconnection of the light emitting element 22, to prevent erroneous lighting, and the like. In addition, it is also possible to provide a cover portion for covering the wiring pattern 26, the film-like resistor, and the like. The cover portion can include, for example, a glass material.

The power supplying portion 30 has a plurality of power supply terminals 31. The plurality of power supply terminals 31 are provided on the inside of the socket 10 (insulating portion 13). The plurality of power supply terminals 31 extend on the inside of the insulating portion 13. One-side end of the plurality of power supply terminals 31 protrudes from an end surface of the insulating portion 13 on a side opposite to the flange 14 side and is electrically connected to the wiring pattern 26 provided in the substrate 21. The other end of the plurality of power supply terminals 31 protrudes from the end surface 13*a* of the insulating portion 13 on the flange 14 side. The other end of the plurality of power supply terminals 31 is exposed on the inside of the hole 17*b*. The number and a shape of the power supply terminals 31, and the like are not limited to the examples described above, and can be appropriately changed.

In addition, the power supplying portion 30 can include a substrate (not illustrated), circuit components (for example, capacitors, resistors, and the like), and the like. Moreover, the substrate (not illustrated), the circuit components, and the like can be provided on the inside of the storage portion 10*a*, the inside of the heat radiating portion 10*b*, and the like.

Next, the heat radiation of the vehicle lighting device 1 having the light distribution characteristics for vehicle which are wide in the horizontal direction and are narrow in the vertical direction will be further described.

Heat generated in the light emitting module 20 is mainly transmitted to the heat radiating fins 16 via the loading portion 15 and the flange 14. Heat transmitted to the heat radiating fins 16 is mainly discharged from the heat radiating fins 16 to the outside.

Here, in a case of the vehicle lighting device 1, in general, forced cooling (forced air cooling) by fins and the like is not performed. Therefore, the heat radiation from the heat radiating fins 16 is mainly performed by convection (natural air cooling). In this case, since gas surrounding the heat radiating fins 16 is warmed by heat discharged from the heat radiating fins 16, the rising air flow 300 as illustrated in FIG. 2 is generated.

The heat radiation from the heat radiating fins 16 depends on the rising air flow 300. Therefore, if flow of the rising air flow 300 is hindered, there is a concern that improvement of the heat radiation is not achieved.

Here, the convex portion 17 and the heat radiating fins 16 are provided on the surface 14*b* of the flange 14. Therefore, the convex portion 17 is provided in a position in which the flow of the rising air flow 300 is not hindered in a region in which the plurality of heat radiating fins 16 are provided.

For example, as illustrated in FIG. 2, the convex portion 17 and the plurality of heat radiating fins 16 can be provided side by side in the X direction. Therefore, the flow of the rising air flow 300 can be prevented from being hindered by the convex portion 17 in the region in which the plurality of heat radiating fins 16 are provided.

In this case, if a dimension of the convex portion 17 in the X direction is small, it is possible to make the region in which the plurality of heat radiating fins 16 are provided wide. If the region in which the plurality of heat radiating fins 16 are provided can be widened, since the number of the heat radiating fins 16 can be increased, it is possible to further improve the heat radiation.

Moreover, the convex portion 17 may not be provided. However, even in this case, the connector 105 is provided in the position (position to which one side end of the plurality of power supply terminals 31 protrudes) of the convex portion 17. In this case, since the connector 105 is also a factor of hindering the flow of the rising air flow 300, it is possible to be considered similar to the convex portion 17.

As illustrated in FIG. 2, in the vehicle lighting device 1, the plurality of power supply terminals 31 are provided side by side in a row in the Z direction. Therefore, since the dimension (or dimension of the connector 105) of the convex portion 17 in the X direction can be small, the region in which the plurality of heat radiating fins 16 are provided can be widened. As a result, since the number of the heat radiating fins 16 can be increased, it is possible to further improve the heat radiation.

That is, in the vehicle lighting device 1, the plurality of light emitting elements 22 are provided side by side in a row in the X direction. In addition, the plurality of power supply terminals 31 are provided side by side in a row in the Z direction orthogonal to the X direction.

Therefore, the vehicle lighting device 1 has the light distribution characteristics for vehicle which are wide in the horizontal direction and is narrow in the vertical direction, and it is possible to improve the heat radiation.

In addition, as illustrated in FIG. 2, in the vehicle lighting device 1 according to the embodiment, the plurality of heat radiating fins 16 are provided side by side in a row in the X direction. In addition, the heat radiating fins 16 has a shape extending straightly in the Z direction. Therefore, the flow of the rising air flow 300 in the region in which the plurality of heat radiating fins 16 are predetermined can be prevented from being hindered by the heat radiating fins 16.

That is, in the vehicle lighting device 1, the plurality of light emitting elements 22 are provided side by side in a row in the X direction. In addition, the plurality of heat radiating fins 16 are provided side by side in a row in the X direction.

Therefore, the vehicle lighting device 1 has the light distribution characteristics for vehicle which are wide in the horizontal direction and is narrow in the vertical direction, and it is possible to improve the heat radiation.

Figure 5:
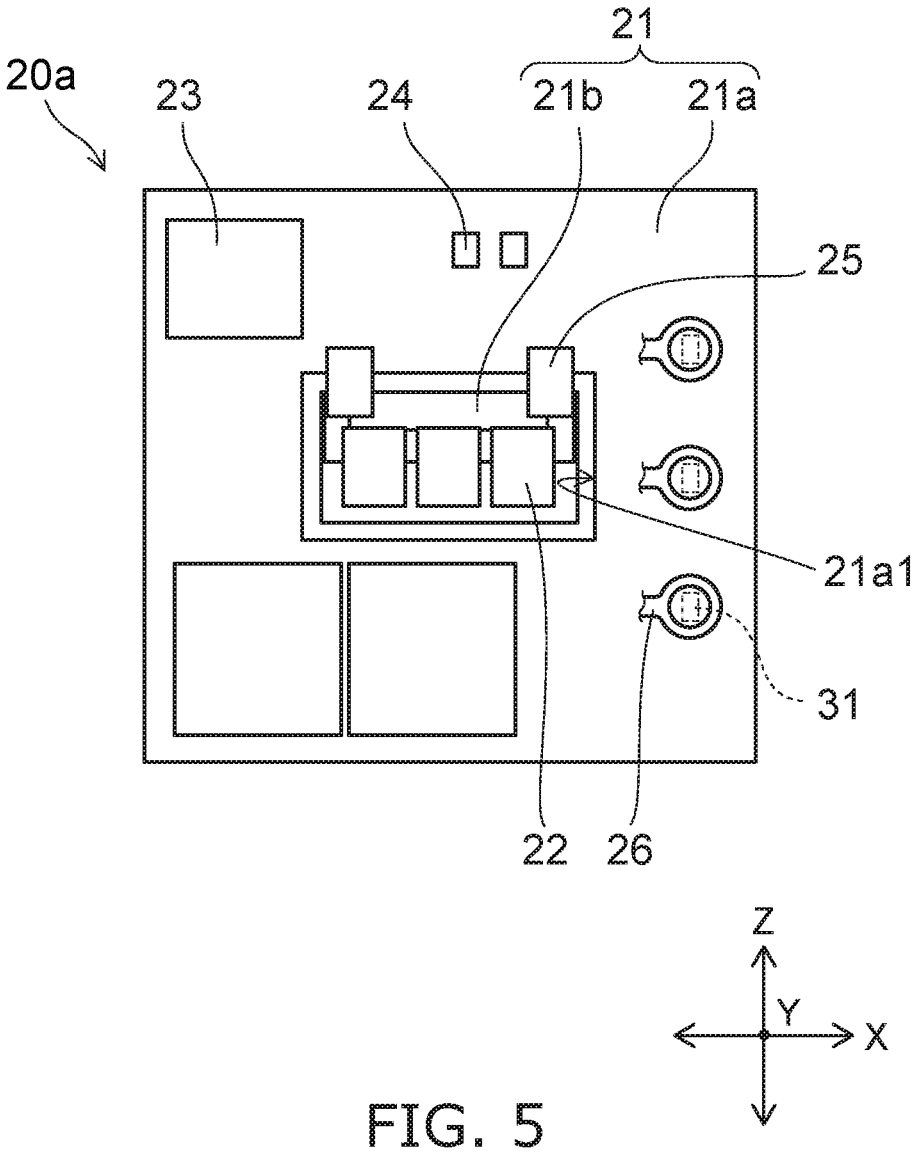
FIG. 5 is schematic plan view illustrating a light emitting module according to another embodiment.

FIG. 5 is schematic plan view illustrating a light emitting module 20*a* according to another embodiment.

As illustrated in FIG. 5, the light emitting module 20*a* has a first portion 21*a*, a second portion 21*b*, a connecting portion 25, the light emitting elements 22, the control element 23, and the control element 24.

Moreover, the first portion 21*a* and the second portion 21*b* are obtained by dividing the substrate 21 described above into two portions.

Similar to the substrate 21 described above, the first portion 21*a* are provided on the surface 15*b* of the loading portion 15. The first portion 21*a* has a plate shape. The first portion 21*a* has a hole 21*a*1 penetrating in a thickness direction. The hole 21*a*1 can be provided in a center region of the first portion 21*a*. A dimension of the hole 21*a*1 is greater than an external dimension of the second portion 21*b*. In addition, the wiring pattern 26 is provided on a surface of the first portion 21*a*.

Electronic components (for example, the control element 23, the control element 24, integrated circuits, resistors (pull-down resistor and the like), capacitors, and the like) other than the light emitting element 22 can be provided in the first portion 21*a*. A heating value of the electronic components provided in the first portion 21*a* during energization is smaller than a heating value of the light emitting element 22 during energization. The electronic components such as the control element 23 and the control element 24 are electrically connected to the wiring pattern 26 provided on the surface of the first portion 21*a*. In addition, the plurality of power supply terminals 31 are electrically connected to the wiring pattern 26 provided on the surface of the first portion 21*a*. In addition, a cover portion for covering the wiring pattern 26, a film-like resistor, and the like can also be provided. The cover portion can include a glass material. In addition, the first portion 21*a* may be a single layer or may be a multi-layer.

Similar to the substrate 21 described above, the second portion 21*b* is provided on the surface 15*b* of the loading portion 15. The second portion 21*b* has a plate shape. The second portion 21*b* is provided on the inside of the hole 21*a*1. The second portion 21*b* may be in contact with the first portion 21*a* or a gap may be provided between the second portion 21*b* and the first portion 21*a*. In addition, the wiring pattern 26 is provided on the surface of the second portion 21*b*.

The plurality of light emitting elements 22 are provided on the second portion 21*b*. The plurality of light emitting elements 22 are electrically connected to the wiring pattern 26 provided on the surface of the second portion 21*b*.

Moreover, in a case of the light emitting element 22 that is mounted by the COB, it is possible to provide the light emitting element 22 of a chip shape, wiring electrically connecting the light emitting element 22 and the wiring pattern 26, a frame-like member surrounding the light emitting element 22 and the wiring, a sealing portion provided on an inside of the frame-like member, and the like on the second portion 21*b*. In addition, a cover portion for covering the wiring pattern 26 and the like can be provided. The cover portion can include the glass material. In addition, the second portion 21*b* may be a single layer or may be a multi-layer.

The connecting portion 25 electrically connects the wiring pattern 26 provided on the surface of the first portion 21*a* and the wiring pattern 26 provided on the surface of the second portion 21*b*. Therefore, the power supply terminal 31 is electrically connected to the light emitting element 22 via the wiring pattern 26 provided on the surface of the first portion 21*a*, the connecting portion 25, the wiring pattern 26 provided on the surface of the second portion 21*b*.

A form of the connecting portion 25 is not particularly limited. The connecting portion 25 can be a wiring member that is soldered, a wiring member having a connector, wiring that is connected using a wire bonding method, and the like.

Here, if the first portion 21*a* and the second portion 21*b* are formed using a material having high thermal conductivity, it is possible to improve the heat radiation of the vehicle lighting device 1. However, in general, the material having high thermal conductivity is expensive. Therefore, if the first portion 21*a* and the second portion 21*b* are formed using the material having high thermal conductivity, there is a concern that the manufacturing cost of the vehicle lighting device 1 is increased.

In this case, a heating value of electronic components other than the light emitting element 22 during energization is much smaller than the heating value of the light emitting element 22 during energization. In addition, even if a temperature of the electronic components other than the light emitting element 22 is slightly increased, possibility that the function of the vehicle lighting device 1 is lowered is small. Therefore, the thermal conductivity of the first portion 21*a* can be lower than the thermal conductivity of the second portion 21*b*.

In general, a material having low thermal conductivity is less expensive than the material having high thermal conductivity. In addition, an area of the second portion 21*b* is smaller than an area of the first portion 21*a*. Therefore, if the second portion 21*b* having a small area is formed of the material (expensive material) having high thermal conductivity and the first portion 21*a* having a large area is formed of the less expensive material (material having low thermal conductivity), it is possible to improve the heat radiation and to achieve reduction in manufacturing coat.

In this case, the first portion 21*a* can be formed of a material of which the thermal conductivity is 0.4 W/(mk) or more and 24 W/(mk) or less. For example, the first portion 21*a* can be formed of paper phenol, glass epoxy, resin having high thermal conductivity, aluminum oxide, one that is obtained by covering a surface of a metal plate with an insulating material, and the like.

The second portion 21*b* can be formed of a material of which the thermal conductivity is 1 W/(mk) or more and 170 W/(mk) or less. The second portion 21*b* can be formed, for example, of resin having high thermal conductivity, aluminum oxide, one that is obtained by covering a surface of a metal plate with an insulating material, silicon nitride, aluminum nitride, and the like.

Figure 6:
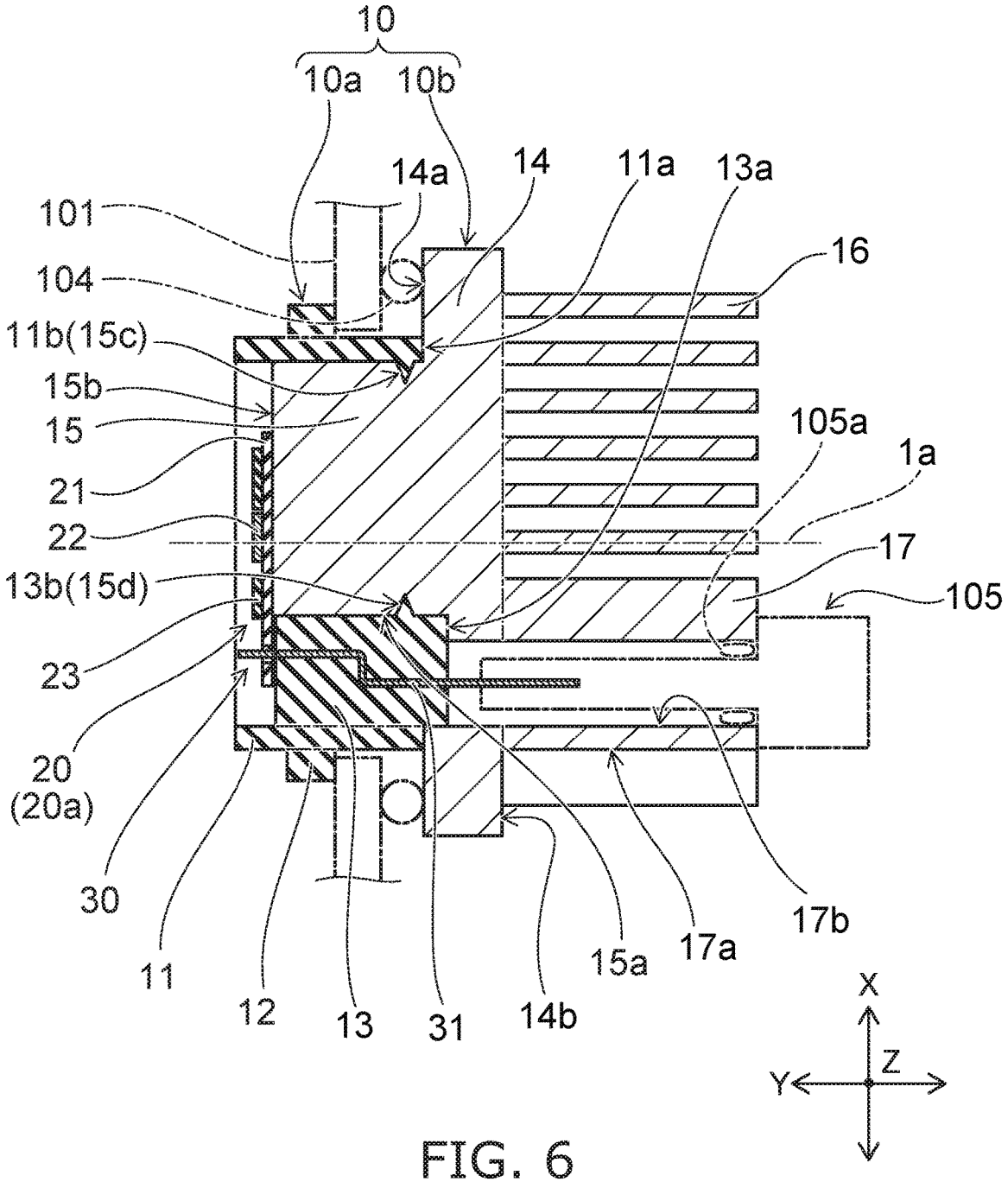
FIG. 6 is schematic sectional view illustrating a mounting portion, an insulating portion, and a loading portion according to another embodiment.

FIG. 6 is schematic sectional view illustrating a mounting portion 11, an insulating portion 13, and a loading portion 15 according to another embodiment.

As illustrated in FIG. 6, a convex portion 11*b* can be provided on an inside surface (inner wall) of the mounting portion 11. A concave portion 15*c* can be provided in a position of an outside surface (outer wall) of the loading portion 15 corresponding to the convex portion 11*b*. The concave portion 15*c* can be fitted to the convex portion 11*b*.

Therefore, release strength between the mounting portion 11 and the loading portion 15 can be increased. Moreover, a concave portion is provided on the inside surface (inner wall) of the mounting portion 11 and a convex portion may be provided on the outside surface (outer wall) of the loading portion 15.

A convex portion 13*b* can be provided on an inside surface (inner wall) of the insulating portion 13. A concave portion 15*d* can be provided in a position of an outside surface (outer wall) of the loading portion 15 corresponding to the convex portion 13*b*. The concave portion 15*d* can be fitted to the convex portion 13*b*. Therefore, the release strength between the insulating portion 13 and the loading portion 15 can be increased. Moreover, a concave portion is provided on the inside surface (inner wall) of the insulating portion 13 and a convex portion can be provided on the outside surface (outer wall) of the loading portion 15.

The number, arrangement positions, shapes, sizes of the convex portion 11*b*, the concave portion 15*c*, the convex portion 13*b*, and the concave portion 15*d*, and the like are not limited to the examples described above, and can be appropriately changed. For example, the convex portions 11*b* may be continuously provided on the inside surface (inner wall) of the mounting portion 11 or may be partially provided. The convex portions 13*b* may be continuously provided on the inside surface (inner wall) of the insulating portion 13 or may be partially provided. The concave portion 15*c* and the concave portion 15*d* may be continuously provided on the outside surface (outer wall) of the loading portion 15 or may be partially provided. In addition, the convex portion 11*b* and the convex portion 13*b* may be integrally provided. The concave portion 15*c* and the concave portion 15*d* may be integrally provided.

In addition, arrangement positions, shapes, sizes, and the like of the convex portion 11*b* and the convex portion 13*b* may be equal or may be different. Arrangement positions, shapes, sizes, and the like of the concave portion 15*c* and the concave portion 15*d* may be equal or may be different.

Here, for example, when the mounting portion 11 having the convex portion 11*b* and the loading portion 15 having the concave portion 15*c* are formed, and the loading portion 15 is inserted into the mounting portion 11, it is also contemplated that the convex portion 11*b* is fitted into the concave portion 15*c*. However, doing so, a height dimension (protrusion dimension) of the convex portion 11*b* (concave portion 15*c*) cannot be too long. In addition, a cross section shape of the convex portion 11*b* (concave portion 15*c*) is also limited to have an inclined surface and the like. Therefore, there is a concern that a certain limit occurs in a joint strength between the mounting portion 11 and the loading portion 15. In addition, if the convex portion 11*b* is fitted into the concave portion 15*c*, since a clearance is required between the mounting portion 11 and the loading portion 15, there is a concern that a backlash occurs.

If the socket 10 is formed by integrally molding the storage portion 10*a* and the heat radiating portion 10*b*, it is possible to simultaneously form the convex portion 11*b* fitted to the concave portion 15*c*. The integral molding can be performed using an insert molding method. Moreover, it is possible to integrally mold the storage portion 10*a*, the heat radiating portion 10*b*, and the power supply terminal 31 using the insert molding method.

If the storage portion 10*a* and the heat radiating portion 10*b* are integrally molded, there is no limit in the height dimension and a cross sect shape of the convex portion 11*b* (concave portion 15*c*). Therefore, the joint strength between the storage portion 10*a* and the heat radiating portion 10*b* can be set within a desired range. In addition, it is possible to eliminate the backlash between the storage portion 10*a* and the heat radiating portion 10*b*.

Next, the vehicle lamp 100 is exemplified.

Moreover, hereinafter, as an example, a case of a front combination light in which the vehicle lamp 100 is provided in the automobile will be described. However, the vehicle lamp 100 is not limited to the front combination light provided in the automobile. The vehicle lamp 100 may be a vehicle lamp provided in an automobile, a railway vehicle, and the like.

FIG. 7 is a schematic partial sectional view illustrating the vehicle lamp 100.

As illustrated in FIG. 7, the vehicle lighting device 1, the housing 101, a cover 102, an optical element portion 103, the sealing member 104, and the connector 105 are provided in the vehicle lamp 100.

The housing 101 has a box shape of which one end portion is opened. The housing 101 can be formed of, for example, resin and the like through which light is not transmitted. An attachment hole 101*a* into which a portion of the mounting portion 11 in which the bayonet 12 is provided is inserted is provided in a bottom surface of the housing 101. Concave portions into which the bayonets 12 provided in the mounting portion 11 are inserted are provided in a periphery of the attachment hole 101*a*. Moreover, a case the attachment hole 101*a* is directly provided in the housing 101 is exemplified, but an attaching member having the attachment hole 101*a* may be provided in the housing 101.

When attaching the vehicle lighting device 1 to the vehicle lamp 100, portions of the mounting portion 11 in which the bayonets 12 are provided are inserted into the attachment hole 101*a* and the vehicle lighting device 1 is rotated. Then, the bayonets 12 are held by the concave portions provided on the periphery of the attachment hole 101*a*. Such a mounting method is called a twist-lock.

When attaching the vehicle lighting device 1 to the vehicle lamp 100, the vehicle lighting device 1 is attached in the direction illustrated in FIG. 1.

That is, the plurality of light emitting elements 22 are provided side by side in a row in the X direction (horizontal direction). Therefore, it is possible to obtain the light distribution characteristics which are wide in the horizontal direction and are narrow in the vertical direction.

In addition, the plurality of power supply terminals 31 are provided side by side in a row in the Z direction (vertical direction). The plurality of heat radiating fins 16 are provided side by side in a row in the X direction (horizontal direction). The heat radiating fins 16 have the shape extending straightly in the Z direction (vertical direction). Therefore, the flow of the rising air flow 300 in the region in which the plurality of heat radiating fins 16 are provided can be prevented from being hindered by the convex portion 17, the connector 105, and the heat radiating fins 16.

As described above, the vehicle lighting device 1 has the light distribution characteristics for vehicle which are wide in the horizontal direction and are narrow in the vertical direction, and it is possible to improve the heat radiation.

The cover 102 is provided so as to close an opening of the housing 101. The cover 102 can be formed of resin and the like having a light-transmitting property. The cover 102 can have functions of a lens and the like.

Light emitted from the vehicle lighting device 1 is incident on the optical element portion 103. The optical element portion 103 performs reflection, diffusion, guiding, and condensing of the light emitted from the vehicle lighting device 1, formation of a predetermined light distribution pattern, and the like.

For example, the optical element portion 103 illustrated in FIG. 7 is a reflector. In this case, the optical element portion 103 reflects the light emitted from the vehicle lighting device 1, and causes the predetermined light distribution pattern to be formed. If the optical element portion 103 is the reflector, the optical element portion 103 is provided on the inside of the housing 101 so as to be coaxially with the center axis of the attachment hole 101*a*.

The sealing member 104 is provided between the flange 14 and the housing 101. The sealing member 104 can have an annular shape. The sealing member 104 can be formed of a material having elasticity such as rubber or silicone resin.

When mounting the vehicle lighting device 1 on the vehicle lamp 100, the sealing member 104 is interposed between the flange 14 and the housing 101. Thus, an inside space of the housing 101 is closed by the sealing member 104. In addition, as described above, the interface between the mounting portion 11 and the flange 14 is sealed by the sealing member 104. In addition, the bayonets 12 are pressed against the housing 101 by elastic force of the sealing member 104. Thus, the vehicle lighting device 1 can be suppressed to be separated from the housing 101.

The connectors 105 are fitted into end portions of the plurality of power supply terminals 31 exposed on the inside of the hole 17*b*. Power supply (not illustrated) and the like are electrically connected to the connectors 105. Therefore, power supply (not illustrated) and the like are electrically connected to the light emitting elements 22 by fitting the connectors 105 into the end portions of the power supply terminals 31.

In addition, the connectors 105 have stepped portions. Then, the sealing member 105*a* is attached to the stepped portions (see FIG. 3). The sealing member 105*a* is provided to prevent entrance of water on the inside of the hole 17*b*. When the connector 105 having the sealing member 105*a* is inserted into the hole 17*b*, the hole 17*b* is sealed to be water tightness.

The sealing member 105*a* can have an annular shape. The sealing member 105*a* can be formed of a material having elasticity such as rubber or silicone resin. The connector 105 can also be joined to an element on the socket 10 side using adhesive or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle lighting device comprising:

a loading portion;

a substrate provided on one end side of the loading portion, the substrate including a first portion and a second portion, the first portion in which a hole penetrating in a thickness direction and a wiring pattern to which a plurality of power supply terminals are electrically connected are provided, and the second portion which is provided on an inside of the hole of the first portion and has a thermal conductivity higher than a thermal conductivity of the first portion, and in which the wiring pattern, to which a plurality of light emitting elements are electrically connected, is provided;

the plurality of light emitting elements that are electrically connected to the wiring pattern provided on a surface of the substrate and provided side by side in a row in a first direction; and the plurality of power supply terminals that are electrically connected to the wiring pattern provided on the surface of the substrate, wherein end portions of the power supply terminals on the substrate side are provided side by side in a row in a second direction, the second direction being perpendicular to the first direction and the center axis of the vehicle lighting device.

2. The device according to claim 1, wherein the first direction is a direction that is a horizontal direction when the vehicle lighting device is attached to a vehicle lamp.

3. The device according to claim 1, wherein the second direction is a direction that is a vertical direction when the vehicle lighting device is attached to a vehicle lamp.

4. The device according to claim 1, further comprising:

a plurality of heat radiating fins that are provided on a side opposite to a side of the loading portion on which the substrate is provided and are provided side by side in a row in the first direction.

5. The device according to claim 4, wherein the heat radiating fins have a plate shape and extend in the second direction.

6. The device according to claim 1, further comprising:

a connecting portion that electrically connects the wiring pattern provided in the first portion and the wiring pattern provided in the second portion.

7. The device according to claim 1, wherein the thermal conductivity of the first portion is 0.4 W/(mk) or more and 24 W/(mk) or less.

8. The device according to claim 1, wherein the thermal conductivity of the second portion is 1 W/(mk) or more and 170 W/(mk) or less.

9. The device according to claim 1, wherein the hole is provided in a center region of the first portion.

10. The device according to claim 1, further comprising:

an electronic component electrically connected to the wiring pattern provided in the first portion.

11. The device according to claim 10, wherein a heating value of the electronic component during energization is smaller than a heating value of the light emitting element during energization.

12. The device according to claim 1, further comprising:

a cover portion that includes a glass material and covers the wiring pattern provided in the first portion.

13. The device according to claim 1, further comprising:

a cover portion that includes a glass material and covers the wiring pattern provided in the second portion.

14. The device according to claim 1, wherein a dimension of the row of the plurality of light emitting elements in the first direction is longer than a dimension of the row of the plurality of light emitting elements in the second direction.

15. The device according to claim 1, wherein the plurality of light emitting elements are light emitting elements of a surface mounting type.

16. The device according to claim 1, wherein the plurality of light emitting elements have a chip shape and are mounted on the surface of the substrate by COB.

17. The device according to claim 1, further comprising:

a mounting portion that has a tubular shape and surrounds the loading portion; and a plurality of bayonets that are provided on an outside surface of the mounting portion.

18. The device according to claim 17, wherein a first convex portion or a first concave portion is provided on an inside surface of the mounting portion, and a second concave portion fitted to the first convex portion or a second convex portion fitted to the first concave portion is provided in a position of an outside surface of the loading portion corresponding to the first convex portion or the first concave portion.

19. A vehicle lamp comprising:

the vehicle lighting device according to claim 1; and a housing to which the vehicle lighting device is attached.

* * * * *